United States Patent [19]

Kearns

[11] Patent Number: 4,832,634

[45] Date of Patent: May 23, 1989

[54] FLOW CONTROL AND PROTECTOR DEVICE FOR AN OUTBOARD MOTOR

[76] Inventor: Alvin L. Kearns, Box 369, R.D. #1, Sutersville, Pa. 10583

[21] Appl. No.: 134,503

[22] Filed: Dec. 16, 1987

[51] Int. Cl.[4] ..... B63H 1/16

[52] U.S. Cl. ..... 440/67; 440/39

[58] Field of Search ..... 440/66, 67, 71–73, 440/76, 39; 416/179, 189, 191, 192

[56] References Cited

U.S. PATENT DOCUMENTS

| | | | |
|---|---|---|---|
| 2,551,371 | 5/1951 | Grigg | 440/71 |
| 2,963,000 | 12/1960 | Fester | 440/71 |
| 2,983,246 | 5/1961 | Manley | 440/72 |
| 3,099,240 | 7/1963 | Montague, Jr. | 440/71 |
| 3,658,028 | 4/1972 | Koons | 440/71 |
| 4,428,735 | 1/1984 | Gruzling et al. | 440/76 |
| 4,487,152 | 12/1984 | Larson | 440/66 |
| 4,680,017 | 7/1987 | Eller | 440/66 |
| 4,699,597 | 10/1987 | Oja | 440/39 |

FOREIGN PATENT DOCUMENTS

| | | | |
|---|---|---|---|
| 509171 | 1/1955 | Canada | 440/66 |
| 1543181 | 9/1968 | France | 440/71 |
| 55-4208 | 1/1980 | Japan | 440/66 |
| 384736 | 9/1973 | U.S.S.R. | 440/67 |

*Primary Examiner*—Joseph F. Peters, Jr.
*Assistant Examiner*—Jesus D. Sotelo
*Attorney, Agent, or Firm*—Nixon & Vanderhye

[57] ABSTRACT

A device for protecting a propeller of a boat motor and for improving the efficiency and therefore the performance characteristics of the motor. The device includes a tubular shroud main body portion which includes a pair of half-sections pivotally secured to one another about a first pair of lower, axially aligned edges. Fastening devices are provided along a second pair of upper, axially aligned edges for clamping the half-sections about the propeller. Mounting plate assemblies are mounted on the main body portion half-sections adjacent the upper, axially aligned edges for resiliently gripping a pair of anti-cavitation plates projecting horizontally outwardly from the motor housing. The shroud main body portion is also provided with an elongated slot along the first pair of axially aligned edges for receiving a skeg projecting downwardly from the housing below the propeller. Forward and rearward grills are provided to prevent inflow of trash or other debris into the shroud. In addition, the shroud main body portion tapers axially, from forward end to rearward end to create a venturi effect as flow exits the shroud.

19 Claims, 3 Drawing Sheets

FIG. 1
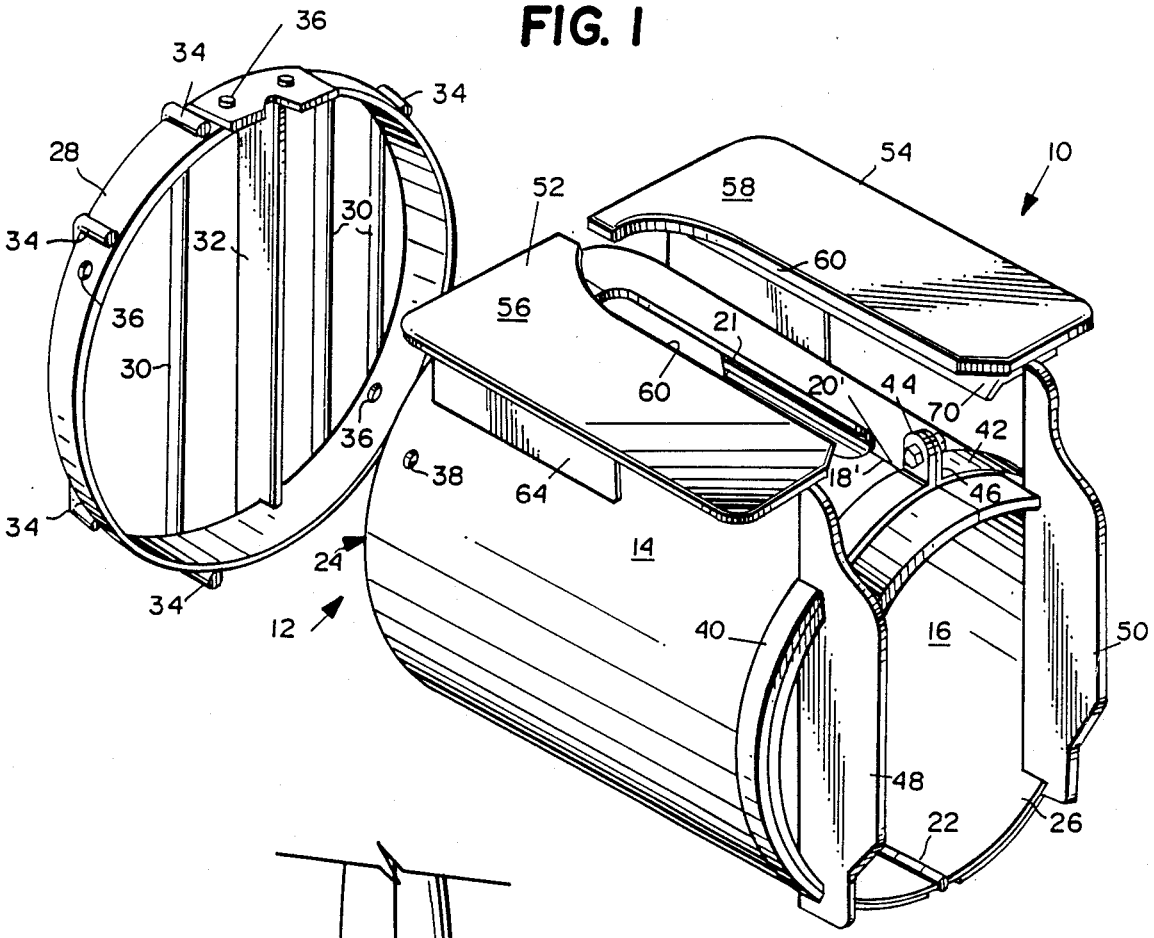
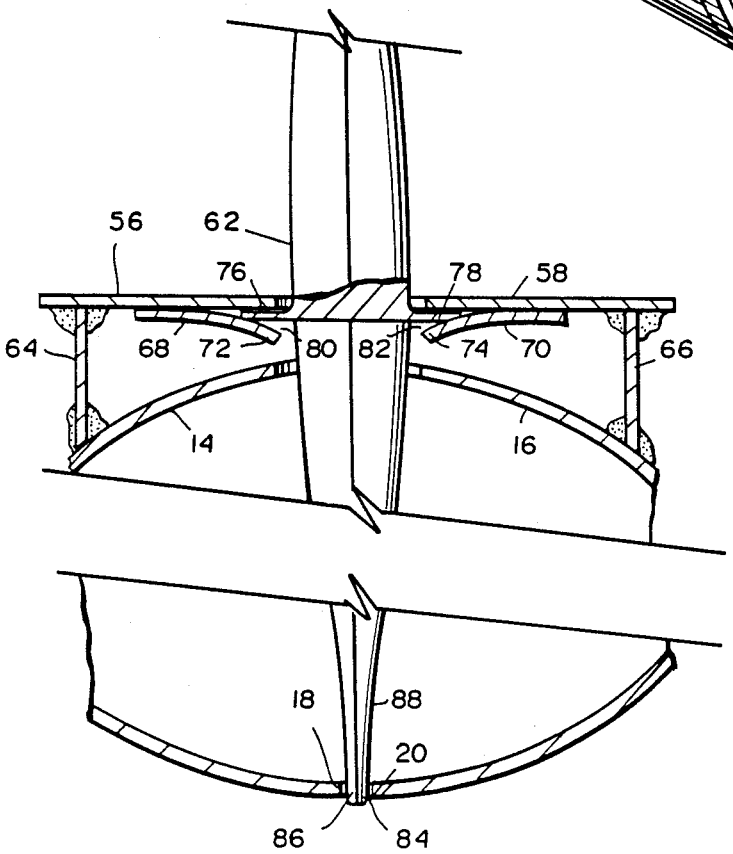
FIG. 2

FLOW CONTROL AND PROTECTOR DEVICE FOR AN OUTBOARD MOTOR

BACKGROUND AND SUMMARY OF THE INVENTION

This invention is related to boat motors, and primarily, but not necessarily limited to, outboard motors. More specifically, the invention relates to a flow device which not only protects the propeller blades of a boat motor, but also enhances the performance of the motor itself by increasing efficiency.

There have been previous attempts to provide devices which protect boat propellers and/or enhance performance by directing or confining flow in the area of the propeller in a rearward direction. In this regard, attention is directed to U.S. Pat. Nos. 4,680,017; 4,428,735; 3,658,028; 3,099,240; 2,963,000; French Pat. No. 1,543,181; and Canadian Pat. No. 509,171.

However, the prior art devices are often difficult to install by reason of their rigid and generally solid cylindrical configuration, or otherwise complex construction. The present invention represents an improvement over such prior art devices in that it is of relatively simple construction and characterized by ease of installation and removal. The invention effectively protects the propeller from trash, debris, rocks and the like, which could otherwise cause significant damage. At the same time, the invention increases the efficiency of the motor which, in turn, enhances the motor's overall performance characteristics.

In the present invention, an elongated open-ended, i.e., tubular, shroud is provided for enclosing the propeller of an outboard boat motor. The shroud is formed in two half-sections, hinged together about an axis lying on the periphery of the shroud and extending parallel to both the longitudinal axis of the shroud, and the axis of rotation of the propeller. In the preferred embodiment, a piano-type hinge extends from the forward to rearward end of the shroud, interrupted only by a relatively short elongated slot designed to receive the motor housing skeg as explained more fully below.

The hinge is located on the bottom, or lower, peripheral portion of the shroud (the "bottom" in the context of this invention referring to the lowermost portion of the shroud, when in position about the propeller of a generally upright motor). Thus, it will be appreciated that the half-sections may be pivoted "upwardly" to a "closed" position completely surrounding the propeller, such that the longitudinal axis of the shroud is substantially coincident with the axis of rotation of the propeller.

The half-sections of the shroud are also provided with one or more fastener-type elements so that, after the shroud halves have been closed about the propeller, they may be clamped together by nuts and bolts, screws, or the like. The closed shroud has a generally cylindrical configuration, although it is preferably tapered slightly, front-to-rear, so that the diameter of the shroud at the inlet or forward end is larger than the diameter of the shroud at the outlet or rearward end. The shroud, whether or not tapered, confines flow in a substantially linear direction, thereby increasing efficiency by preventing radial dissipation of a portion of the energy generated by the propeller. The tapered configuration further ensures that, when the boat is traveling in a forward direction, a solid body of water exits the shroud at increased velocity, due to a venturi effect established at the rearward end of the shroud.

Substantially open grills are provided for the forward and rearward ends of the shroud or housing, each including a plurality of vertically oriented fins or rods which do not restrict flow but which are sufficient to prevent trash and other debris from entering the shroud and damaging the propeller. The vertically oriented vanes, or rods also tend to reduce turbulence by smoothing the flow entering and/or leaving the shroud.

In one exemplary embodiment, one grill is formed as a separate ring-like component which may be slipped onto one end of the closed shroud, while the other grill is formed integrally with the shroud half-sections. By this arrangement, the separable grill, once attached, serves to hold the half-section portions of the shroud together. It is contemplated, however, that even with the removable grill feature, one or more additional fasteners will be employed to secure the shroud halves in the closed position during use as previously described.

In another exemplary embodiment, the grills are formed in sections and are integral with, or permanently attached to, the respective shroud half-sections.

The flow directing device of this invention is designed to engage the boat motor housing at no fewer than three points of attachment. First, the shroud is provided with an elongate slot along the hinge, for receiving the lower tip of a skeg. The skeg is a vertically oriented fin, found on most outboard motor designs, which projects downwardly from the lowermost portion of the motor housing, below the propeller.

An upper portion of the shroud is provided with a pair of mounting plate assemblies which are designed to resiliently engage and clamp a respective pair of anti-cavitation plates which extend horizontally outwardly from either side of the housing, above the propeller. the anti-cavitation plates are designed to prevent water from being sucked, or drawn, from above and into the propeller area.

In the exemplary embodiments of this invention, the mounting plate assemblies are located adjacent the free edges of the shroud half-sections, i.e., in the closed position, a mounting plate assembly extends along a significant portions of the length of the shroud, on either side of the motor housing, just above the propeller.

Each mounting plate assembly includes a vertically oriented supporting wall and a first horizontal plate, supported by the vertical wall, which extends inwardly toward the motor housing as further explained below. A second horizontal plate is fixed to the underside of the first horizontal plate, with one elongated edge, i.e., the inward edge facing the motor housing, substantially aligned with a corresponding edge of the first horizontal plate. The first and second horizontal plates are attached at selected locations by brazing, welding or other suitable means, which nevertheless permit resilient separation of the plates along the aligned edges.

The mounting plate assemblies are mounted on the shroud, in such a way that, as the shroud half-sections are closed about the propeller, the anti-cavitation plates are wedged between the first and second horizontal plates of each mounting plate assembly. In this regard, one or both of the first and second horizontal plates of each assembly is constructed of spring steel to create a resilient gripping action on the anti-cavitation plates.

In addition to the above described points of attachment with the motor housing, additional fasteners are employed, as previously described, to clamp the shroud half-sections to each other, so that the shroud is securely and firmly attached to the motor housing, with no possibility of the shroud becoming misaligned or otherwise interfering with the operation of the motor.

Once attached to the motor, the shroud of this invention effectively prevents the propeller from coming into contact with the trash, debris, rocks or other harmful solid material. At the same time, the shroud has significant safety related aspects insofar as it prevents hand, foot, or other contact with the propeller by the boat operator or others when the motor is in the water or out. The shroud also transforms the usual turbulence associated with this type of motor into useable flow by confining and directing the flow in a front-to-back direction, to thereby improve motor efficiency. As previously noted, a preferred, tapered shroud configuration creates a venturi effect at the rearward end of the shroud, thereby increasing the flow velocity and further improving performance.

It will therefore be appreciated that the invention is characterized by significant protective, safety, performance, and ease of installation features which heretofore have been unavailable in the prior art.

While described primarily with respect to single propeller outboard motor, it will be understood that the present invention may also be adapted for use with dual propeller outboard motors as well as inboard motors. The shroud may also be adapted to fit motors of different sizes in the various categories mentioned.

Further objects and advantages of the invention will become apparent from the detailed description which follows.

BRIEF DESCRIPTION OF THE DRAWINGS

FIG. 1 is a perspective view of a flow directing shroud in accordance with the invention, with a forward grill ring removed for clarity;

FIG. 2 is a partial section view illustrating the manner of attachment of a shroud to an outboard motor housing in accordance with the invention;

DETAILED DESCRIPTION OF THE DRAWINGS

Figure 3:
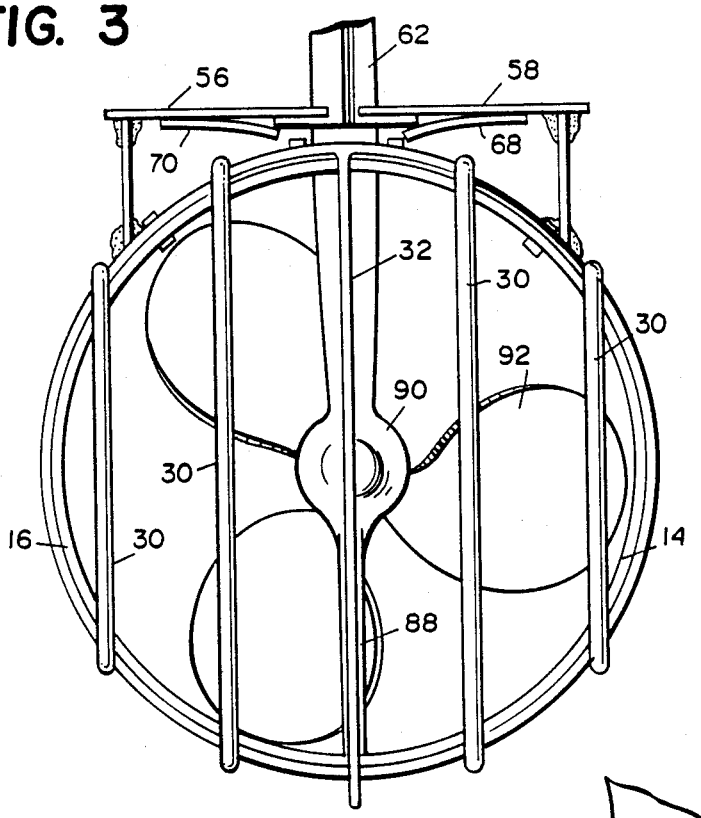
FIG. 3 is a front end view of a shroud of the type illustrated in FIG. 1.

Referring now to FIGS. 1 through 4, a flow control device 10 is shown which includes a shroud main body portion 12 which is comprised of half-sections 14 and 16. These sections are pivotally secured to each other along a pair of substantially abutting lower edges 18, 20 by a suitable hinge mechanism, such as the piano hinge 22.

In the closed position, where upper free edges 18', 20', respectively, are in engagement, the shroud half-sections generally define an elongated cylinder having an open forward end 24, and an open rearward end 26. It will be understood that the upper free edges 18', 20' are profiled, or cut, to form a cavity or aperture 21 which accommodates the motor housing when the shroud half-sections are closed.

In a preferred embodiment, the shroud body 12 tapers from front to back, so that the diameter at the forward opening is larger than the diameter at the rearward opening. In an exemplary embodiment, the taper may reduce the rearward opening diameter about an inch relative to the forward opening diameter, e.g., 11 inches to 10 inches for one particular motor.

The forward open end 24 is designed to receive a substantially open grill assembly comprising a substantially annular ring 28 and a plurality of vertically oriented metal rods 30 which extend across the open space defined by the ring. In the preferred embodiment, a centrally located, vertical grill component is formed as a fin or vane 32. Vane or fin 32 may be secured to the ring by any suitable means such as by brazing or with individual fasteners or the like. Rods 30 are formed with bent-over ends or tips 34 which, again, may be brazed or otherwise secured to the ring. The periphery of the ring is provided with apertures 36 which, when the ring is mounted over the forward edge of the main body portion 12, can be aligned with apertures 38 formed in the latter. Screws or other fasteners then may be employed to securely fasten the ring 28 to the shroud body portion 12.

The forward grill prevents debris from being drawn into the shroud and smooths the fluid flow into the shroud.

Figure 4:
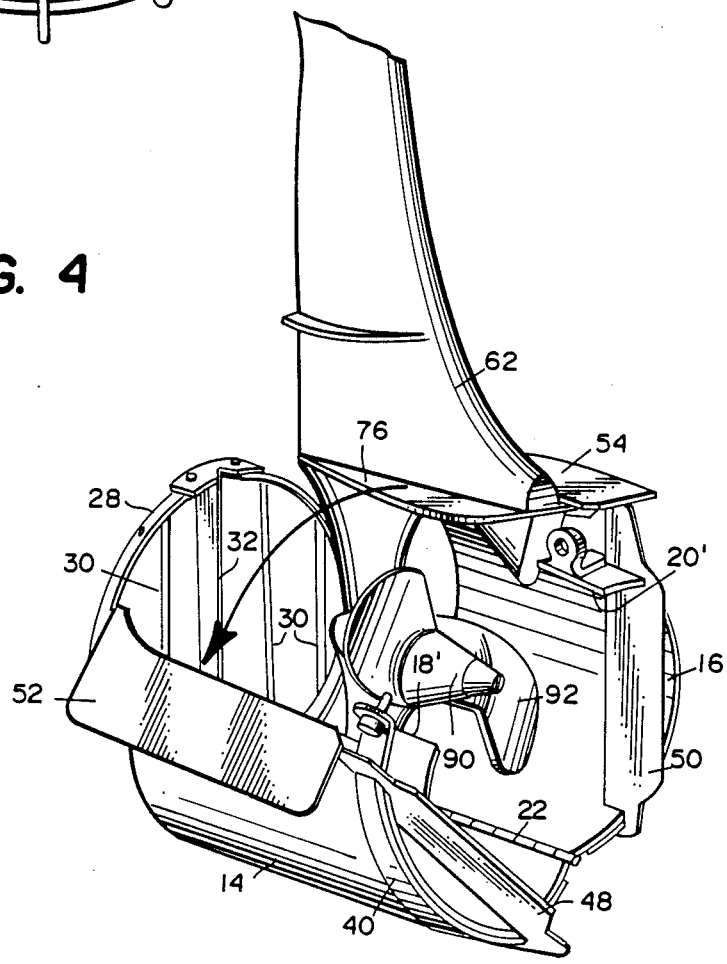
FIG. 4 is a perspective view of a shroud of the type illustrated in FIG. 1 in an open position relative to an outboard motor housing.

As best seen in FIGS. 1 and 4, the exterior surface of the rearward end 26 of the shroud is provided with peripherally extending straps 40, 42 brazed or otherwise secured to the shroud half-sections 14, 16. The upper ends of the generally semi-circular straps are bent to form upstanding flanges 44, 46, respectively, and are provided with apertures (not shown) for receiving suitable fastening means, such as a nut and bolt arrangement or similar. In the closed position, the upstanding flanges 44, 46 of the respective straps are in back-to-back relationship as shown in FIG. 1.

It will be appreciated that any suitable securing or locking arrangement could be provided to clamp the shroud half-sections together in the area of the upper free edges 18', 20'.

Also attached to the straps 40, 42 are a pair of vertically oriented fins or vanes 48, 50. Each fin or vane is formed with a pair of elongated slots which permit the fin or vane to be received over the respective straps and shroud half-sections at two spaced points, in a manner resembling a chord of a circle, the fin or vane representing the chord. It will thus be understood that the fins or vanes 32, 34 form a substantially open grill which also protects the propeller and which reduces turbulence by smoothing the flow exiting the shroud.

Both forward and rearward grills, of course, also provide protection for persons swimming near the boat, or when the boat motor is operated out of water, as for testing, maintenance and the like.

Mounted on the upper side, and extending along the shroud body portion 12, adjacent upper free edges 18', 20' are a pair of identical mounting plate assemblies 52, 54. Each assembly includes a substantially flat, first horizontal plate 56, 58, respectively, each of which has an inwardly facing profiled edge 60 which conforms generally to the contour of the motor housing 62. In the closed position, the profiled edges are adapted to engage the motor housing, providing lateral support for the shroud.

Each assembly further includes a vertically oriented support wall 64, 66 respectively which mount the plates 56, 58 above the shroud half-sections. Second horizontal plates 68, 70 are brazed or welded to the underside of the first, or upper, horizontal plates 56, 58 at selected locations such that the inner edges 72, 74 are substantially aligned with edges 60, and are free to flex downwardly so as to receive anti-cavitation plates 76, 78 between the upper and lower horizontal plates, as best seen in FIGS. 2 and 3.

The inwardly directed edges 72, 74 of the second, or lower, plates may be pre-bent downwardly to present entry grooves 80, 82 to, and thereby facilitate reception of, the cavitation plates located on either side of the boat motor housing. In this manner, when the shroud half-sections are closed about the motor housing, the boat anti-cavitation plates will be resiliently wedged between the upper and lower horizontal plates of the shroud mounting plate assemblies 52, 54.

There is one additional point of attachment between the shroud and the boat motor. As previously indicated, the piano hinge 22 is interrupted approximately midway along its length by a relatively short, elongated slot 84 which receives the lowermost tip 86 of a skeg or fin 88 which projects below a hub 90 which mounts the propeller 92.

By this arrangement, a secure attachment between the motor housing and the shroud is assured, so that there is little or no possibility of the shroud working itself loose or otherwise interfering with the propeller.

The above described configuration produces a slight venturi effect as the water exits the shroud and further insures a solid body of water within the shroud, thereby reducing or eliminating cavitation, and improving motor efficiency.

In terms of materials used to form the flow control device as described herein, the shroud portion is preferably formed of 20 or 22 gauge sheet stainless. Other suitable metals or rigid high-impact plastics could also be employed. For example, the shroud half-sections could be made of die cast aluminum.

The mounting plate components, and particularly one or both pair of the horizontal plates are preferably made of spring steel, 18 or 20 gauge, permitting a resilient clamping of the housing anti-cavitation plates as previously described.

Figure 5:
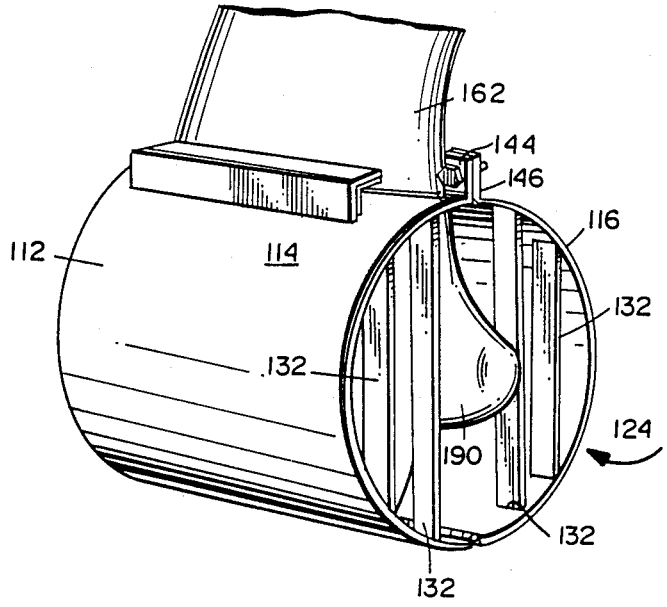
FIG. 5 is a perspective view of another exemplary embodiment of the invention.
Figure 6:
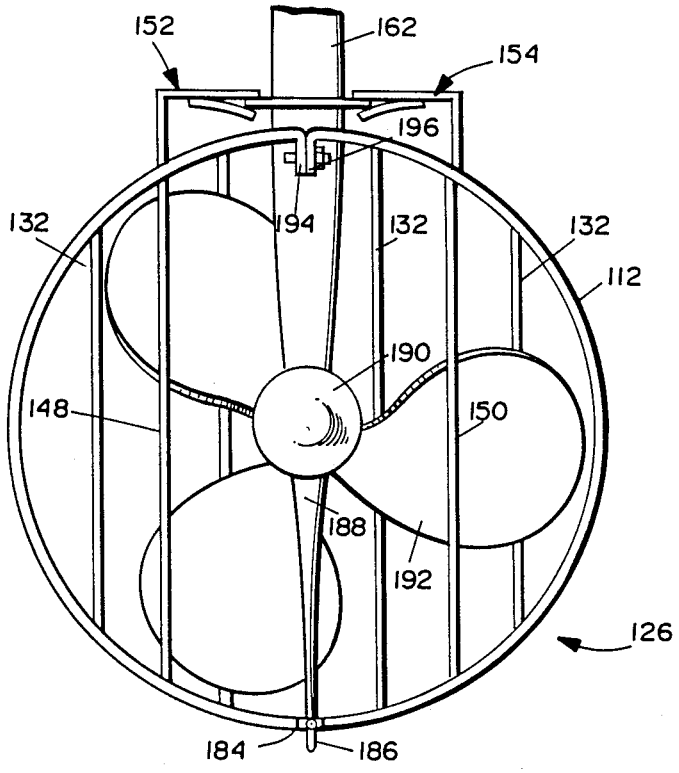
FIG. 6 is a front view of the shroud illustrated in FIG. 5.

In a further embodiment, as shown in FIGS. 5 and 6, (components corresponding to those in FIGURES 1 through 4 have like reference numerals, preceded by a 1) the forward and rearward shroud grills are formed integrally with the shroud half-sections. Thus, as shown best in FIG. 5, the forward end 124 of the shroud body 112 is provided with a plurality of metal strips or vanes 132 which are brazed or welded, in place, to the shroud half-sections 114 and 116.

The rearward end 126, illustrated in FIG. 6, is likewise formed with a pair of vanes 148, 150 which are also brazed or welded in place.

In this embodiment, back-to-back, upwardly extending tabs or flanges 144, 146 are provided at the rearward end for clamping the shroud half-sections closed in a manner similar to the first-described embodiment, utilizing appropriate fasteners such as nuts, bolts, screws or the like. At the forward end, inwardly directed tabs or flanges 194, 196 are provided, and serve to clamp the shroud in a similar manner. Of course, other fastening arrangements, such as right angle brackets or the like, could be secured to the shroud half-sections in back-to-back relationship as will be understood by those skilled in the art.

In addition, it will be appreciated that other arrangements for various of the components of the invention are possible. For example, the entirety of the mounting plate assembly could be double-layered. That is, plate assemblies 52, 54 (or 152, 154), for example, may be made simply by folding a double layer spring steel plate in a right angle configuration, with the inwardly facing edges designed for separation and resilient gripping of an associated anti-cavitation plate. This configuration has the added benefit of additional reinforcement in the vertical wall portions of the mounting plate assemblies.

The above described grill components may also be modified to assume various configurations, and particularly with respect to the size of the grill openings, and therefore the size of objects permitted to pass into the shroud.

In addition, it is to be understood that the invention is easily adapted to a number of outboard motors of various sizes and designs, as well as inboard motors. Thus, the forward and rearward diameters of the shroud, the vertical distance of the horizontal plates above the shroud, and the profile of the upper free edges of the shroud may be varied as required, depending on motor housing shape, propeller size, and so on.

While the invention has been described in what is presently regarded as its most practical embodiments, various changes and modifications are contemplated which nevertheless remain within the scope of the invention.

I claim:

1. A device for protecting the propeller of a boat motor and for controlling flow in the area of the propeller wherein the boat motor includes a housing, a pair of anti-cavitation plates and a downwardly projecting skeg, the device comprising:

an open-ended shroud including a main body portion having a pair of pivotally attached half-sections adapted to enclose the propeller and further including forward and rearward ends, each end having an associated protective grill, and a pair of mounting plate assemblies located above the main body portion, each of said assemblies including upper and lower horizontally oriented plates adapted to resiliently grip one of said anti-cavitation plates.

2. A device as defined in claim 1 wherein the shroud main body portion is provided with an elongated slot for receiving the skeg.

3. A device as defined in claim 1 wherein said shroud half-sections are each provided with securing means for clamping said half-sections together.

4. A device as defined in claim 3 wherein said securing means comprise at least a pair of aligned straps, one on each of said shroud half-sections.

5. A device as defined in claim 4 wherein said half-sections are adapted for pivotal movement between a first, open and inoperative position, and a second, operative position wherein said shroud half-sections axially enclose the boat motor propeller, so that flow is confined in a direction substantially parallel to the axis of rotation of the propeller.

6. A device as defined in claim 1 wherein at least one of said grills is removable relative to said shroud.

7. A device as defined in claim 1 wherein said grills are formed integrally with said shroud half-sections.

8. A device for protecting the propeller of a boat motor and for controlling flow in the area of the propeller wherein the boat motor includes a housing, a pair of anti-cavitation plates and a downwardly projecting skeg, the device comprising:

an open-ended shroud including a main body portion adapted to enclose the propeller and further including forward and rearward ends, each end having an associated protective grill, and a pair of mounting plate assemblies located above the main body portion, each of said assemblies including upper and lower horizontally oriented plates adapted to resiliently grip one of said anti-cavitation plates, and wherein said shroud is tapered from a larger diameter at the forward end to a smaller diameter at the rearward end, so that, in use, a venturi effect is created as flow exits the shroud when the boat is moving in a forward direction.

9. A flow control device for protecting the propeller of an outboard boat motor provided with a housing, said device comprising:

(a) split shroud means including a main body portion having open forward and rearward ends for enclosing a boat motor propeller so as to confine water flow in a substantially single direction, between said forward and rearward ends, said split shroud means including a pair of hinged half-sections adapted to be pivotally moved between inoperative and operative positions relative to the housing and the propeller;

(b) grill means for protecting said propeller associated with said split shroud means at said forward and rearward ends; and (c) attachment means for clamping said hinged half-sections together about said propeller.

10. A flow control device as defined in claim 9 wherein said half-sections are hinged along a pair of first axially directed edges extending between said forward and rearward ends.

11. A flow control device as defined in claim 10 wherein a pair of second axially directed edges, diametrically opposed to said first axially directed edges, is provided with attachment means for locking said half-sections in a substantially cylindrical configuration.

12. A flow control device as defined in claim 11 wherein said attachment means comprises at least a pair of upstanding flanges and associated fasteners.

13. A flow control device as defined in claim 9 wherein said shroud tapers from a larger diameter forward end to a smaller diameter rearward end.

14. A flow control device as defined in claim 9 and further including an elongated slot along said pair of first axially directed edges, adapted to receive a skeg projecting downwardly from the motor housing.

15. A flow control device as defined in claim 9 and further including means for resiliently gripping a pair of anti-cavitation plates extending horizontally outwardly from the motor housing.

16. A flow control device as defined in claim 15 wherein said anti-cavitation plate gripping means comprises a pair of superposed plates, separable along at least one edge.

17. A flow control device as defined in claim 16 wherein said pair of superposed plates are horizontally disposed above the main body portion of the shroud means.

18. A flow control device as defined in claim 9 wherein said grill means comprise a plurality of vertically oriented rods or fins.

19. A propeller protection and flow control device for a boat motor including a motor housing provided with a vertical skeg and a pair of opposed horizontal anti-cavitation plates, said device comprising:

an open ended, tubular shroud including forward and rearward ends, said shroud including a pair of half-sections pivotally attached along a pair of first axially directed edges, and provided with securing means along a pair of second axial edges opposite said first axial edges; and mounting plate assemblies located above said second axial edges for resiliently gripping the anti-cavitation plates; said shroud also provided with protective grills covering the forward and rearward open ends thereof.

* * * * *